US006138765A

United States Patent [19]

Russell et al.

[11] Patent Number: 6,138,765

[45] Date of Patent: Oct. 31, 2000

[54] PACKER ASSEMBLY FOR USE IN A SUBMERGIBLE PUMPING SYSTEM

[75] Inventors: W. Keith Russell, Windsor, United Kingdom; David L. Fielder, Dewey; Kevin T. Scarsdale, Bartlesville, both of Okla.; Russell Bookout, Fort Wayne, Ind.

[73] Assignee: Camco International, Inc., Houston, Tex.

[21] Appl. No.: 09/128,530

[22] Filed: Aug. 3, 1998

[51] Int. Cl.[7] ..... E21B 33/1295

[52] U.S. Cl. ..... 166/387; 166/66.4; 166/68

[58] Field of Search ..... 166/65.1, 66.4, 166/68, 101, 188, 382, 383, 387

[56] References Cited

U.S. PATENT DOCUMENTS

| | | | |
|---|---|---|---|
| 2,286,365 | 6/1942 | Lane | 166/65 |
| 2,435,179 | 1/1948 | McGovney | 103/46 |
| 2,511,759 | 6/1950 | Williams | 166/1 |
| 2,739,650 | 3/1956 | Hill | 166/106 |
| 2,749,992 | 6/1956 | Hill | 166/106 |
| 3,196,948 | 7/1965 | Dye | 166/65 |
| 3,468,258 | 9/1969 | Arutunoff | 103/87 |
| 3,749,164 | 7/1973 | Moxey | 166/68 |
| 3,853,430 | 12/1974 | O'Rourke | 166/217 X |
| 3,926,254 | 12/1975 | Evans et al. | 166/106 |
| 4,352,394 | 10/1982 | Zehren | 166/106 |
| 4,366,862 | 1/1983 | Brandell | 166/106 |
| 4,372,389 | 2/1983 | Hamrick et al. | 166/369 |
| 4,440,221 | 4/1984 | Taylor et al. | 166/106 |
| 4,621,689 | 11/1986 | Brookbank, III | 166/106 |
| 4,625,798 | 12/1986 | Bayh, III | 166/106 |
| 4,632,184 | 12/1986 | Renfroe, Jr. et al. | 166/105.5 |
| 4,706,746 | 11/1987 | White et al. | 166/106 |
| 5,094,294 | 3/1992 | Bayh, III | 166/106 |
| 5,152,340 | 10/1992 | Clark et al. | 166/122 |
| 5,259,450 | 11/1993 | Fischer | 166/68 |
| 5,540,281 | 7/1996 | Round | 166/250.17 |

*Primary Examiner*—Roger Schoeppel
*Attorney, Agent, or Firm*—Fletcher, Yoder & Van Someren

[57] ABSTRACT

A packer assembly simplifies the location and relocation of a bottom intake electric submergible pumping system within a wellbore. The packer assembly includes a packer mandrel on which a packer is received and held in place. The packer mandrel includes a housing that forms an internal passage through which wellbore fluids are pumped. The housing also includes an outer surface that forms a recess in which a packer is received and held. The packer may be a conventional type hydraulically set or mechanically set packer. Thus, the packer may be set independently of actuation of the pump at any location within the wellbore casing. When the submergible pumping system must be moved or serviced, the packer assembly and the remainder of the submergible pumping system are moved as a single unit.

20 Claims, 4 Drawing Sheets

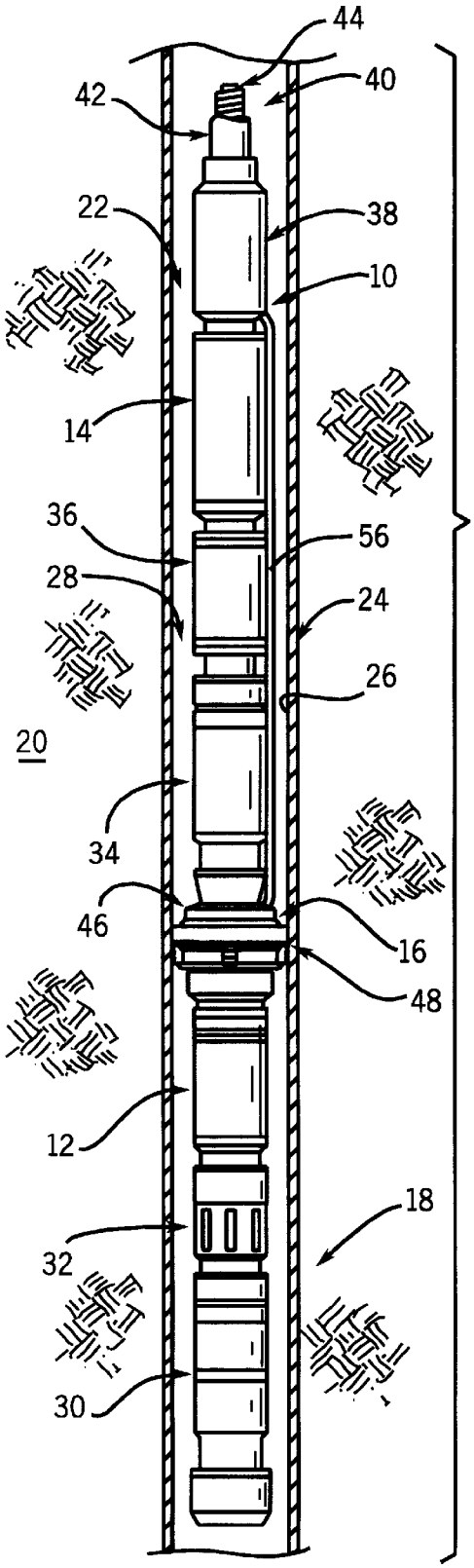
FIG. 1
FIG. 2
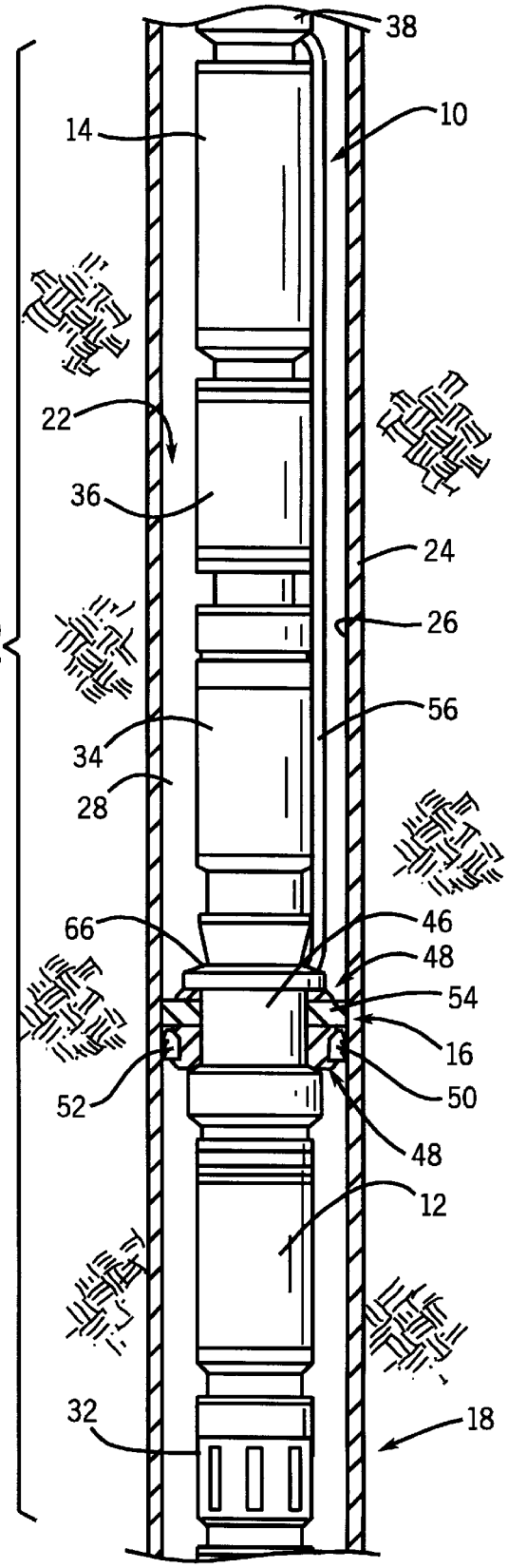

PACKER ASSEMBLY FOR USE IN A SUBMERGIBLE PUMPING SYSTEM

FIELD OF THE INVENTION

The present invention relates generally to pumping systems for raising fluids from wells and, more particularly, to a packer assembly, including a packer mandrel and a packer that is integrally connected within the submergible pumping system for movement with the system in a manner that allows the packer to be set at various locations within the wellbore.

BACKGROUND OF THE INVENTION

In producing petroleum and other useful fluids from production walls, it is generally known to provide a submergible pumping system for raising the fluids collected in a well. Production fluids enter a wellbore via. perforations formed in a well casing adjacent a production formation. Fluids contained in the formation collect in the wellbore and may be raised by the submergible pumping system to a collection point above the earth's surface.

In a conventional bottom intake electric submergible pumping system, the system includes several components, such as a submergible electrical motor that supplies energy to a submergible pump. The system may further include a motor protector for isolating the motor from well fluids. A motor connector may also be used to provide a connection between the electrical motor and an electrical power supply. These and other components may be combined in the overall submergible pumping system.

Generally, the submergible pump and pump intake are disposed beneath the motor and protector. This system is lowered into a wellbore casing until it is submerged or at least partially submerged in the wellbore fluids. Somewhere between the pump intake and the pump discharge, the submergible pumping system must be sealed with respect to the wellbore casing such that production fluids, e.g., petroleum, may be pumped into the annulus formed about the submergible pumping system within the wellbore casing. The production fluid is continually pumped into this annulus such that the production fluid rises to the top of the wellbore casing at or above the earth's surface. The entire submergible pumping system is deployed in the wellbore casing by, for instance, a cable or coil tubing so that the system may later be retrieved.

Current bottom intake electrical submergible pumping systems basically are set at a predetermined location within the wellbore casing, and that location cannot be changed without substantial additional steps beyond simply lifting or moving the submergible pumping system. For example, in some applications, a permanent packer is installed in the wellbore, and the submergible pumping system stings into the packer. In other applications, a liner having a seating shoe is run inside the production casing. The bottom intake electric submergible pumping system engages and seals against this seating shoe. In either of these applications, movement of the pumping system to another location along the wellbore casing requires that another permanent packer be set or the liner and seating shoe be moved in an operation separate from movement of the submergible pumping system. Additionally, servicing of the submergible pumping system and packer/seating shoe requires at least two trips out of the well, adding many hours of down time.

Previously, an attempt was made to combine a submergible pumping system with an integral packer. In the subject system, the packer is set against the well casing upon initiation of the pump via the electric motor. However, this is problematic, because most wellbore fluid pumping applications require that the pumping system be set in place within the wellbore casing prior to pump start-up.

It would be advantageous to utilize a packer mandrel connected within the string of components of the submergible pumping system that could accommodate a packer of the type that could be set independently of initiation of pumping.

SUMMARY OF THE INVENTION

The present invention features a bottom intake electric submergible pump system. The system is designed for use in a wellbore to pump fluids from the wellbore to a location at or above the earth's surface. The system comprises a motor, a protector, a pump, and a packer assembly. The packer assembly is connected between the pump and the protector. The packer assembly further includes a mandrel having a recessed region designed to receive and hold a packer. Thus, when the submergible pumping system is moved within the wellbore casing, the motor, the protector, the pump, and the packer assembly move as an integral unit in a single step. The packer is specifically designed so that it may be set at a desired location prior to starting the pump.

According to another aspect of the invention, a packer assembly is designed for use with a submergible pumping system of the type that is inserted into a wellbore to pump wellbore fluids. The packer assembly includes a packer mandrel that may be connected within the submergible pumping system. The packer mandrel includes a housing with a fluid inlet, a fluid outlet, and a fluid passage through which wellbore fluids are pumped from the fluid inlet and out through the fluid outlet. The housing also includes an outer surface that forms a recessed region. A packer is received and held by the recessed region such that the packer is retained on the packer mandrel when the packer mandrel is moved within the wellbore. The packer is preferably of a conventional design that may be set by, for instance, mechanical or hydraulic input at any desired location within the wellbore casing.

According to a further aspect of the invention, a method is provided for installing a submergible pumping system in a wellbore simultaneously with a packer assembly. The method includes assembling at least a motor, a submergible pump, a packer mandrel and a packer as a single submergible pumping system. The pumping system is inserted into a wellbore, and the packer is set at a desired location within the wellbore prior to starting the pump. The packer typically is set by engaging a sidewall of the wellbore. The method further includes starting the pump to pump a wellbore fluid to a point above the packer.

BRIEF DESCRIPTION OF THE DRAWINGS

The invention will hereafter be described with reference to the accompanying drawings, wherein like reference numerals denote like elements, and:

FIG. 1 is a front elevational view of a submergible pumping system positioned in a wellbore, according to a preferred embodiment of the present invention;

FIG. 2 shows a packer assembly, according to a preferred embodiment of the present invention, disposed within the string of submergible pumping system components;

DETAILED DESCRIPTION OF THE PREFERRED EMBODIMENTS

Figure 3:
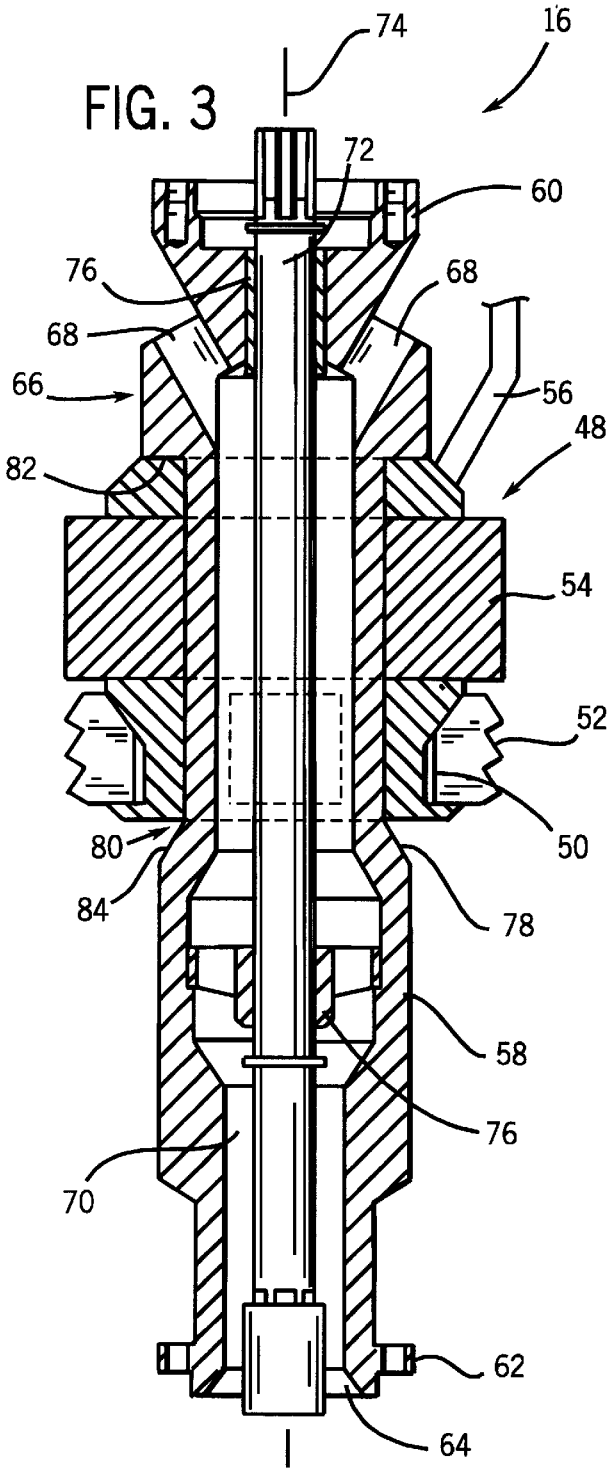
FIG. 3 is a cross-sectional view of the packer assembly illustrated in FIG. 2, taken generally along its longitudinal axes.

Referring generally to FIG. 1, a bottom intake electric submergible pump system 10 is illustrated according to a preferred embodiment of the present invention. Submergible pump system 10 may comprise a variety of components depending on the particular application or environment in which it is used. However, system 10 typically includes at least a submergible pump 12, submergible motor 14, and an integral packer assembly 16. The provision of integral packer assembly 16, within submergible pumping system 10, obviates the need for external seating shoes, running a separate liner, employing landing nipples, or deploying a separate packer prior to deployment of submergible pumping system 10.

As illustrated, system 10 is designed for deployment in a well 18 within a geological formation 20 containing desirable production fluids, such as petroleum. In a typical application, a wellbore 22 is drilled and lined with a wellbore casing 24. The submergible pumping system 10 is then deployed within wellbore 22 to a desired location for retrieval of wellbore fluids. At this location, packer assembly 16 is set and sealed against an interior surface 26 of wellbore casing 24. The production fluids may then be pumped from well 18 via pump 12, powered by motor 14, to a point above packer assembly 16 and discharged into the annulus 28 formed between submergible pumping system 10 and interior surface 26 of wellbore casing 24. As the wellbore fluids are continually pumped into annulus 28 above packer assembly 16, the fluid level rises to a point at or above the earth's surface where the production fluid is collected for further processing.

As illustrated, submergible pumping system 10 typically includes additional components, such as a thrust casing 30, a pump intake 32, through which wellbore fluids enter pump 12, a protector 34, that serves to isolate the well fluid from the motor oil, and an injection line 36. Additionally, a connector 38 is used to connect motor 14 with a deployment system, such as tubing, cable or coil tubing. In the preferred embodiment, the deployment system is a coiled tubing system 40 utilizing a coiled tube 42 having a power cable 44 running through its hollow center as will be described in detail below.

Furthermore, a variety of motors 14 and pumps 12 can be used in submergible pumping system 10. However, an exemplary motor 14 is a three-phase, induction-type motor, and exemplary pump 12 is a multi-staged centrifugal pump. Additionally, additional components can be added, components can be removed, or the sequence of components can be rearranged according to the desired application.

Referring now also to FIGS. 2 and 3, packer assembly 16 includes a discharge head or packer mandrel 46 and a packer 48 integrally mounted on packer mandrel 46 for movement with packer mandrel 46 and the rest of submergible pumping system 10 as it is deployed at a specific location within wellbore 22 or removed from wellbore 22.

Packer 48 is illustrated in simplified form, because a variety of conventional packers can be adapted for use with this submergible pumping system 10. For example, packer 48 may be a mechanically set packer, such as a "J" latch-type packer, a Swab Cup-type packer, or a hydraulic packer. Preferably, packer 48 is a hydraulic packer, such as the Camco HRP-1-SP hydraulic set packer available through Camco International, Inc. of Houston, Tex. A hydraulic set packer generally includes a plurality of slips 50 having friction blocks 52 and a sealing element 54. Slips 50 and friction blocks 52 are deployed against interior surface 26 of casing 24 to hold packer assembly 16 at a given location within wellbore 22. Sealing element 54 typically comprises an elastomeric element that expands to seal between packer mandrel 46 and casing 24 to support the column of production fluid within annulus 28. The specific configuration of packer 48 will depend on the application and the desires of the submergible pumping system operator.

A control line 56 preferably is run from a location at the earth's surface to packer assembly 16 to "set" or engage packer 48 with wellbore casing 24 when desired. In the illustrated embodiment, control line 56 is a hydraulic line that supplies hydraulic fluid to packer 48, thereby providing inputs to selectively set the packer.

Figure 4:
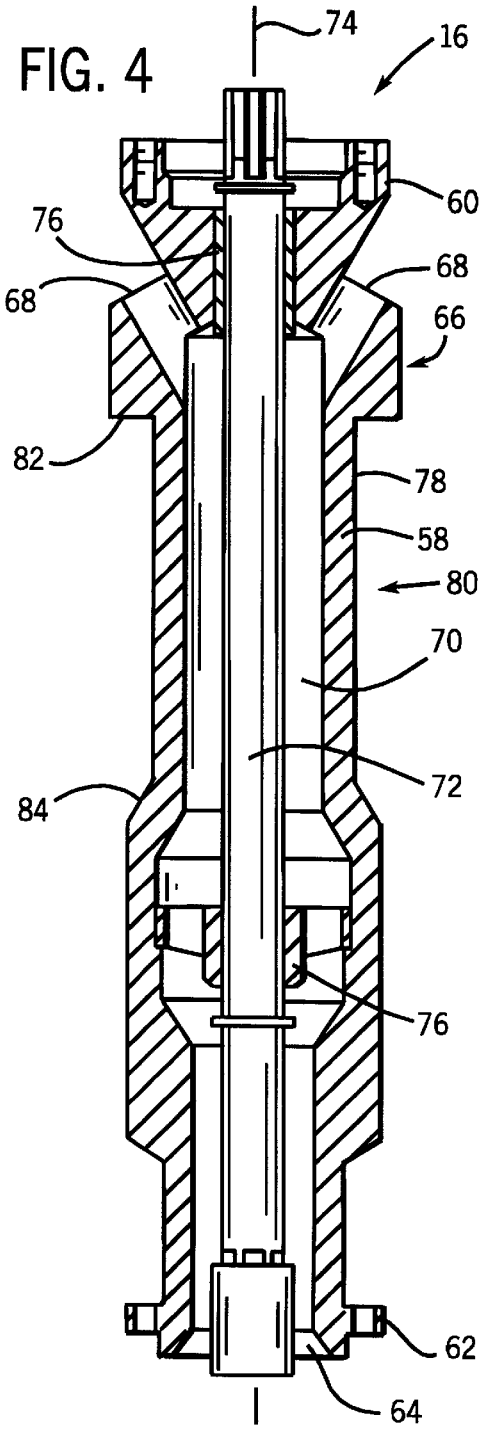
FIG. 4 is a cross-sectional view of the packer mandrel taken generally along its longitudinal axis.

Referring also to FIG. 4, packer mandrel 46 includes a housing 58 that has an upper connector end 60 and a lower connector end 62. Upper connector end 60 is connected, for instance, to the lower portion of protector 34 while lower connector end 62 is connected to, for instance, the upper end of submergible pump 12. Thus, packer mandrel 46 is disposed intermediate pump 12 and motor 14 with motor 14 being disposed above packer mandrel 46 within wellbore 22 while pump 12 is disposed below packer mandrel 46 in wellbore 22.

Housing 58 includes an inlet 64 and a discharge end 66 having an outlet 68. A fluid passage 70 connects inlet 64 and outlet 68 through the interior of housing 58 to permit the flow of wellbore fluids therethrough. Thus, wellbore fluids are taken in through intake 32, pumped through the interior of submergible pump 12 and through fluid passage 70 before entering annulus 28 via outlet 68.

A shaft 72 extends through the center of housing 58 generally along a longitudinal axis 74 to provide power from motor 14 to pump 12. Preferably, shaft 72 extends through the center of fluid passage 70. Bearings, and preferably a pair of bearings 76, hold and support shaft 72 for rotation within housing 58.

Housing 58 is designed to secure packer 48 thereto so that packer 48 is retained as an integral component of submergible pumping system 10 as it is deployed and moved within wellbore 22. In other words, the various components, including packer 48, may be assembled at the surface and deployed in wellbore 22 at any desired location without first deploying a separate packer in a preliminary step and/or without using any seating shoes, separate liners, or landing nipples that fix the location of submergible pumping system 10 at a specific location within wellbore 22. Additionally, because packer 48 is independently controlled via control line 56, it can be set at any time regardless of whether pump 12 has been started or any pumping action has occurred. Specifically, this allows packer 48 to be set at the desired location within wellbore 22 prior to initiation of any pumping action.

In the preferred embodiment, housing 58 includes an exterior surface 78 that forms an engagement region, preferably a recessed region 80, for holding packer 48, as best illustrated in FIG. 3. In this embodiment, recessed region 80 is formed by an upper expanded region 82 of exterior surface 78 and a lower expanded region 84 of exterior surface 78. Packer 48 is held within this recessed region 80 so that it is constrained to movement with packer mandrel 46 and thus submergible pumping system 10. Packer 48 may, for instance, be assembled within recessed region 80 or packer mandrel 46 potentially can be formed as two or more components that are inserted into packer 48 and fastened together by, for instance, a weldment, bolts, or other fasteners. Additionally, packer 48 may be attached to housing 58 at additional points by additional fasteners, weldments, or splines to prevent any rotation of packer 48 with respect to housing 58.

Figure 5:
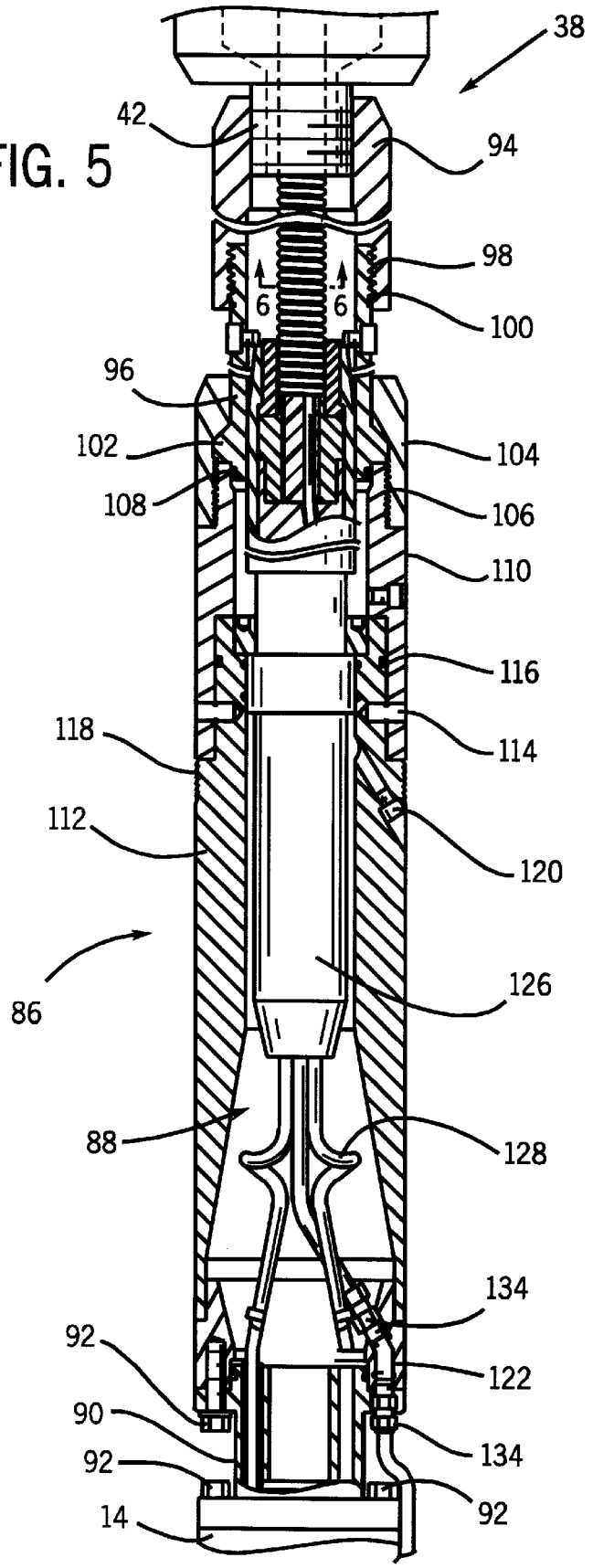
FIG. 5 is a cross-sectional view of a connector, according to a preferred embodiment of the present invention.

Referring generally to FIG. 5, a cross-sectional view of connector assembly 38 is taken generally along a longitudinal axis of connector assembly 38. In the preferred embodiment, connector assembly 38 includes an outer housing 86 that has an interior hollow region 88. Connector assembly 38 includes a lower mounting structure 90 by which it is connected to the next sequential component, preferably motor 14, of submergible pumping system 10. Lower mounting structure 90 may be designed for connection to motor 14 and housing 86 via a plurality of fasteners 92, such as bolts.

In the illustrated embodiment, connector assembly 38 includes a head connector 94 that engages coiled tubing 42. Opposite coiled tubing 42, head connector 94 engages a housing connector 96 via a threaded region 98 and a sealing ring 100. Housing connector 96 includes a radially outwardly extending flange 102 that abuts against a top portion of housing 86. Housing connector 96 and housing 86 are held together by a union 104 that threadably engages housing 86 at a threaded region 106 to pull flange 102 tightly against the top of housing 86, as illustrated in FIG. 5. A seal 108 is disposed between housing connector 96 and housing 86.

Housing 86 includes a collar connector 110 having threaded region 106 disposed along its upper portion. Collar connector 110 is connected to a lower housing connector 112 by a plurality of shear pins 114 and sealed thereto by a seal ring 116. Thus, if submergible pumping system 10 becomes stuck within wellbore 22, head connector 94 and collar connector 110 may be sheared away from lower housing connector 112. Lower housing connector 112 includes a plurality of fishing teeth 118 to permit later retrieval of the remainder of submergible pumping system 10, as is well known by those of ordinary skill in the art.

Housing 86 also includes a drain 120 for draining fluids, as necessary, from interior hollow region 88. Specifically, drain 120 extends through housing 86 from interior hollow region 88 to wellbore 22. Preferably, housing 86 further includes an outlet 122 that can be used to conduct control line 56 from interior hollow region 88 to annulus 28 between submergible pumping system 10 and wellbore casing 24.

Figure 6:
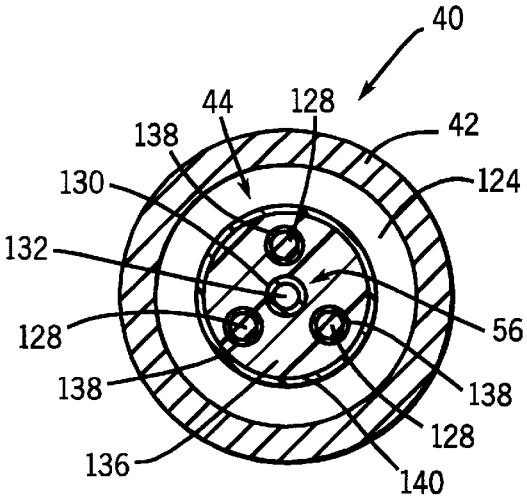
FIG. 6 is a cross-sectional view taken generally along line 6—6 of FIG. 5.

With additional reference to FIG. 6, the present invention preferably utilizes coiled tubing system 40 in which the outer coiled tubing 42 is connected to head connector 94 to suspend submergible pumping system 10 as it is deployed within wellbore 22. Power cable 44 extends through a longitudinal hollow interior 124 of coiled tubing 42. Power cable 44 extends into the interior of housing connector 96 and engages a penetrator 126. Penetrator 126 conducts a plurality of motor conductors 128 to a lower portion of interior hollow region 88 of housing 86. From this point, the individual motor conductors, typically three motor conductors 128, are directed through lower mounting structure 90 for connection with motor 14 to provide appropriate electrical input thereto.

In the preferred embodiment, power cable 44 also includes, as an integral component, control line 56. As illustrated best in FIG. 6, control line 56 may comprise an injection line having an outer wall 130 defining an interior fluid passage 132 for conducting, for instance, hydraulic fluid to packer 48.

In the preferred embodiment illustrated in FIGS. 5 and 6, control line 56 is disposed generally at a central location between electrical motor conductors 128 within power cable 44. The hydraulic control line is then routed through penetrator 126 and out of connector assembly 38 via outlet 122, as illustrated best in FIG. 5. From outlet 122, control line 56 is routed along motor 14 and any other components of submergible pumping system 10 until it reaches packer 48, where it may be connected in a conventional manner. Control line 56 may comprise multiple pieces and also may be held securely in place at outlet 122 by appropriate fasteners 134.

In the preferred embodiment, power cable 44 includes control line 56 disposed generally along its longitudinal axis and through an insulative core 136. Each of the three electrical motor conductors 128 is spaced radially outward from control line 56 and also runs through insulative core 136. Each of the motor conductors 128 may be sheathed in an outer insulative layer 138 that is disposed through insulative core 136, as is understood by those of ordinary skill in the art. Preferably, insulative core 136 is surrounded by an armor layer 140, such as a metallic layer, for added strength and protection.

Figure 7:
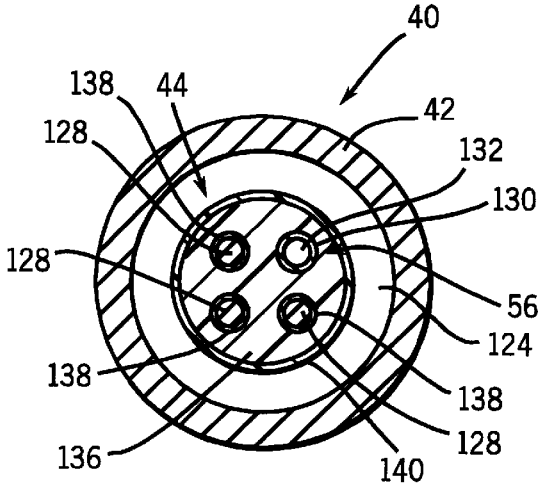
FIG. 7 is an alternate embodiment of the combined power cable and coiled tubing illustrated in FIG. 6.
Figure 8:
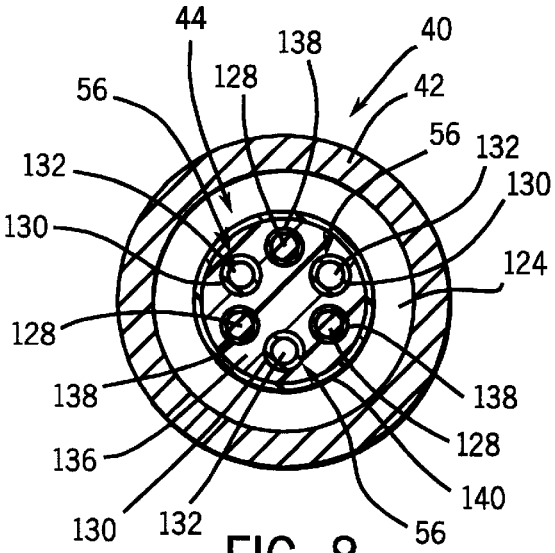
FIG. 8 is an alternate embodiment of the combined power cable and coiled tubing illustrated in FIG. 6.
Figure 9:
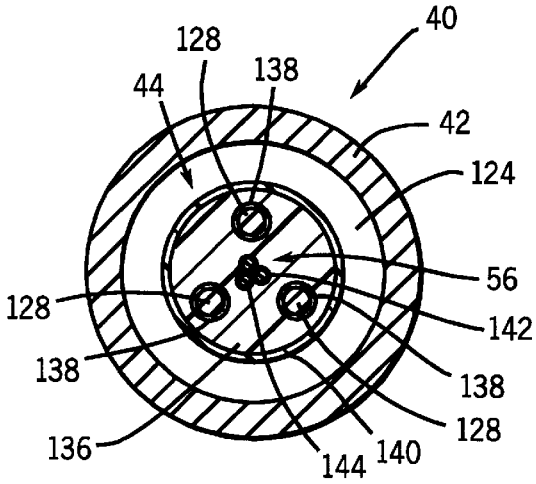
FIG. 9 is an alternate embodiment of the combined power cable and coiled tubing illustrated in FIG. 6.

Although FIG. 6 illustrates the preferred embodiment, a variety of alternate embodiments may be employed, such as those illustrated in FIGS. 7–9. For example, in FIG. 7, control line 56 is disposed through insulative core 136 at a position radially outward from the radial center of power cable 44. In either of the embodiments illustrated in FIG. 6 or 7, control line 56 may comprise an injection line for carrying fluid, such as hydraulic fluid, to packer 48 or other components requiring independent input and actuation. When control line 56 is utilized as an injection line, it does not necessarily need to be used for powering the packer 48 of the preferred embodiment; it also could be used to inject chemical treatment into the production fluid for corrosion control, scale inhibition, etc.

In the alternate embodiment illustrated in FIG. 8, there are a plurality of control lines 56 for independently carrying hydraulic fluid, chemical treatment, or other fluids to various components or locations along submergible pumping system 10. The multiple control lines potentially can be routed through connector assembly 38 or around connector assembly 38 along annulus 28. As illustrated in FIG. 9, control line 56 also may comprise lines for carrying other types of inputs to submergible pumping system 10. For example, control line 56 may comprise an electrical conductor, such as a twisted pair 142 and/or an optical fiber 144 for carrying inputs to selected components of submergible pumping system 10, such as down hole sensors. Additionally, control line or lines 56 may comprise a mixture of control line types, e.g., hydraulic fluid injection lines, electrical conductors or optical fibers.

It will be understood that the foregoing description is of preferred embodiments of this invention, and that the invention is not limited to the specific forms shown. For example, a variety of packers and packer mandrel configurations may be adapted for use in a particular down hole environment; the submergible pumping system may incorporate a variety of additional or different components; the specific design of the connector assembly may incorporate different components and configurations; and the power cable may be constructed in various configurations of a variety of materials conducive for use in a down hole environment. These and other modifications may be made in the design and arrangement of the elements without departing from the scope of the invention as expressed in the appended claims.

What is claimed is:

1. A bottom intake electric submergible pump system for use in a wellbore to pump fluids from the wellbore to a location at or above the earth's surface, comprising:

a motor;

a protector;

a pump; and a packer assembly connected between the pump and the protector, the packer assembly including a mandrel having a recessed region and a packer received and held within the recessed region so as to move with the motor, the protector and the pump to a desired location within the wellbore, wherein the packer may be set at a desired location prior to pumping.

2. The system as recited in claim 1, wherein the mandrel has a fluid passage therethrough, including a fluid inlet and a fluid outlet.

3. The system as recited in claim 2, wherein the mandrel includes a shaft extending therethrough.

4. The system as recited in claim 3, wherein the packer is a hydraulically set packer.

5. The system as recited in claim 3, wherein the packer is a mechanically set packer.

6. A packer assembly for use with a submergible pumping system designed for insertion into a wellbore, comprising:

a packer mandrel that may be connected with the submergible pumping system, the packer mandrel having a housing with a fluid inlet, a fluid outlet and a fluid passage connecting the fluid inlet and the fluid outlet, the housing having an engagement region; and a packer received and held at the engagement region such that the packer is retained by the packer mandrel when the packer mandrel is moved within the wellbore, wherein the packer may be repeatable set at greater or lesser depths within the wellbore independent of any pumping by the submergible pumping system.

7. The packer assembly as recited in claim 6, wherein the engagement region is a recessed region.

8. The packer assembly as recited in claim 6, wherein the packer is a hydraulically set packer.

9. The packer assembly as recited in claim 6, wherein the packer is a mechanically set packer.

10. The packer assembly as recited in claim 6, further comprising a pump having a discharge end, the packer mandrel being connected to the discharge end.

11. The packer assembly as recited in claim 8, further comprising an injection line connected to the packer, the injection line being adapted to carry a fluid used to set the packer.

12. The packer assembly as recited in claim 6, wherein the recessed region extends about the entire circumference of the packer mandrel.

13. The packer assembly as recited in claim 10, further comprising a motor connected to a shaft that extends substantially through the housing, the packer mandrel being disposed between the pump and the motor.

14. A method for installing a submergible pumping system in a wellbore simultaneously with a packer assembly, comprising:

assembling at least a motor, a submergible pump, a packer mandrel and a packer as a single submergible pumping system;

inserting the single submergible pumping system into a wellbore;

providing a control signal to the submergible pumping system to set the packer independent of the operation of the pump;

setting the packer at a desired location within the wellbore to engage a sidewall of the wellbore prior to starting the pump; and starting the pump to pump a wellbore fluid to a point above the packer.

15. The method as recited in claim 14, further comprising pumping the wellbore fluid through a fluid passage within the packer mandrel.

16. The method as recited in claim 15, further comprising locating the packer mandrel and the packer in the single submergible pumping system at a position intermediate the motor and the pump.

17. The method as recited in claim 14, further comprising:

disengaging the packer from the sidewall of the wellbore; and moving the motor, the submergible pump, the packer mandrel and the packer, simultaneously, to a new location.

18. The method as recited in claim 17, further comprising:

reengaging the packer with the sidewall at the new location.

19. The method as recited in claim 14, wherein the step of setting includes setting the packer hydraulically.

20. The method as recited in claim 14, wherein the step of setting includes setting the packer mechanically.

* * * * *